United States Patent [19]

Siegal

[11] 4,207,817

[45] Jun. 17, 1980

[54] CONCENTRIC SPRING SUPPORTED RESILIENT INKING WHEEL

[75] Inventor: Burton L. Siegal, Skokie, Ill.

[73] Assignee: Kiwi Coders Corporation, Wheeling, Ill.

[21] Appl. No.: 939,186

[22] Filed: Sep. 5, 1978

[51] Int. Cl.[2] ..... B41L 27/28

[52] U.S. Cl. ..... 101/348; 101/329

[58] Field of Search ..... 101/329, 335, 337, 348, 101/349, 205; 29/126, 128

[56] References Cited

U.S. PATENT DOCUMENTS

| | | | |
|---|---|---|---|
| 401,335 | 4/1889 | Dodson | 101/329 |
| 1,364,301 | 1/1921 | Paxton | 101/329 |
| 1,402,742 | 12/1921 | Slack | 101/329 |
| 4,121,521 | 10/1978 | Gill | 101/348 |
| 4,126,090 | 11/1978 | McKay | 101/348 |

*Primary Examiner*—E. H. Eickholt

*Attorney, Agent, or Firm*—Silverman, Cass & Singer, Ltd.

[57] ABSTRACT

An inking wheel having a ring formed of firm inking material, said ring being mounted upon a hub by means of a concentric, radially yieldable support comprising a concentrically disposed coil spring, said concentric spring having a pair of outer coils supporting the ring and an inner lesser diameter coil adapted to be frictionally seated on the hub, the inner and outer coils joined integrally by a pair of bridging coils at opposite ends of the inner coil with the resilience being provided thereby.

13 Claims, 4 Drawing Figures

CONCENTRIC SPRING SUPPORTED RESILIENT INKING WHEEL

BACKGROUND OF THE INVENTION

This invention relates generally to rotary inking devices of the type used in apparatus for applying printed indicia upon a moving line of articles and in particular, relates to the provision of a concentric spring loaded inking wheel being radially yieldable yet capable of maintaining concentricity after repeated use thereof.

In the reference copending application there was disclosed rotary inking wheel formed of an outer ring of inking material supported upon a hub or the like by a resiliently yieldable support structure consisting of at least one sleeve and a sponge-like ring formation. A support comprising a pair of concentric sleeves sandwiching a sponge-like annular member was described also. Thus, the inking wheel was provided with sufficient resilience to enable a constant pressure to be exerted upon the inking material without deterioration thereof. In other words, the mounting described afforded to the wheel a little "give" when impacted by the type carried by the imprinting wheel or by one of an intermediate train of transfer wheels.

The described earlier structure functioned well for a considerable duration. Notwithstanding its successful utilization, its adoption was limited since its useful life may be foreshortened due to its inability on recovery after radial movement, to maintain concentricity over sufficient duration of use to be fully satisfactory. The relatively foreshortened life expectancy may have been attributable to fatigue experienced by aging of the foam or sponge material comprising the sandwiched resilient material. It was found that the ring would give but after a relatively short time, would not return consistently to a condition where the desired concentricity would result. Even though protection was provided to avoid contamination by solvents and inks, the possibility of deterioration by exposure to such solvents and inks was one consideration limiting acceptability. Cost was a factor also as well as the number of parts and manner of manufacture of the support assembly, which raised costs of manufacture. Facility of assembly and disassembly was a factor also to be considered in evaluating acceptability to the industry.

Accordingly, it is desirable to improve the resiliently supported inking wheel of the earlier application by providing resilient means showing much reduced fatigue tendencies and which would be capable of maintaining concentricity of the inking wheel over a longer useful life, yet which would be easy to mount and to dismount on the hub of the wheel without loss of advantages which enhance the value of the previously described resiliently supported inking wheel.

Further, it would be of considerable advantage costwise if the above could be accomplished with elimination of the need to provide the molded or otherwise formed sleeves and resilient ring member sandwiched therebetween. All the above advantages would have to be provided without loss of effectiveness.

SUMMARY OF THE INVENTION

An inking ring for transferring ink to a surface in a rolling contact therewith and comprising an outer ring of firm ink absorbent material and an axial hub, the ring mounted on said hub by a concentrically disposed spring formed of a pair of outer coils, and an inner coil, one of said pair of outer coils and said inner coil having an outer diameter selected to engage and support the ring and the other of said pair of outer coils and said inner coil having a diameter selected to enable engagement frictionally with said hub; and connecting coil links at opposite ends of the inner coil joining the outer and inner coils offering the resilient support.

DESCRIPTION OF A PREFERRED EMBODIMENT

Figure 1:
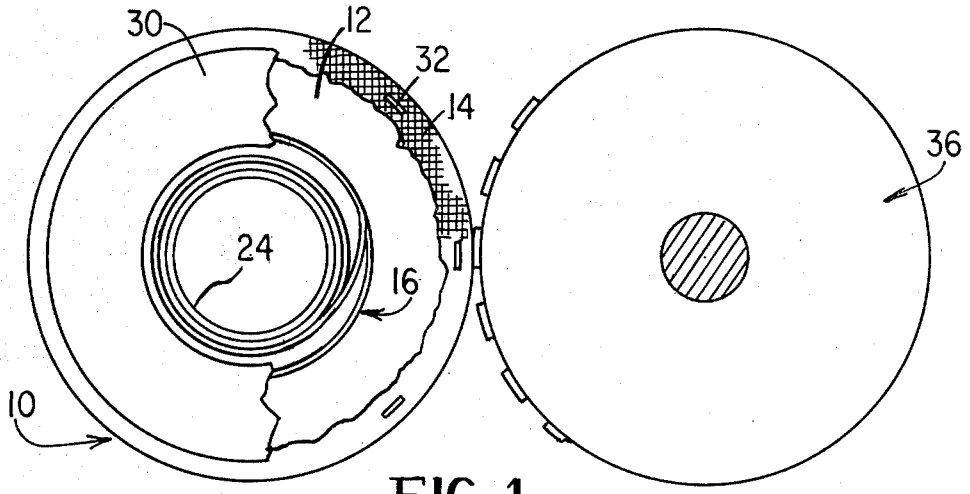
FIG. 1 is a side elevational view of an inking wheel constructed in accordance with the invention shown as employed with an imprinting wheel.
Figure 2:
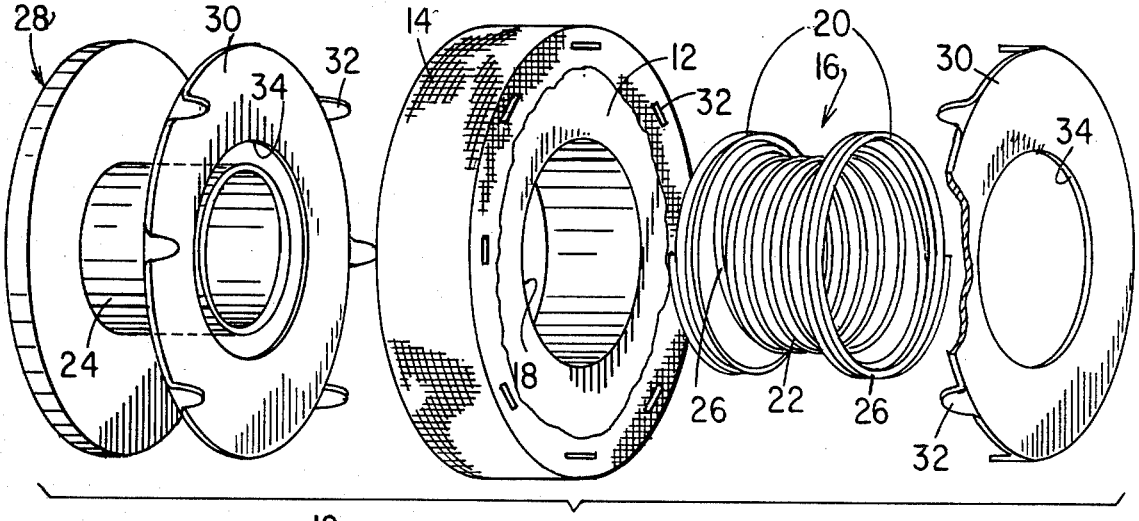
FIG. 2 is an exploded view of the inking wheel illustrated in FIG. 1.
Figure 4:
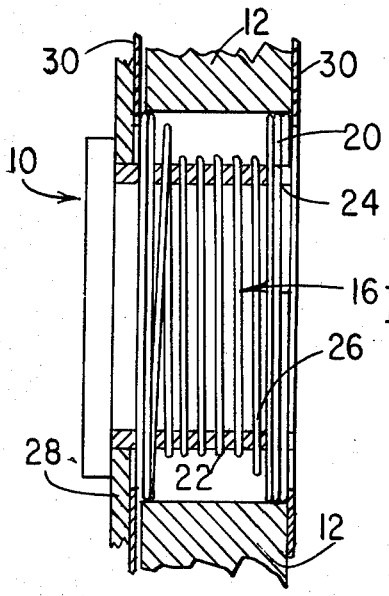
FIG. 4 is an enlarged fragmentary detail of the structure illustrated in FIG. 3.
Figure 3:
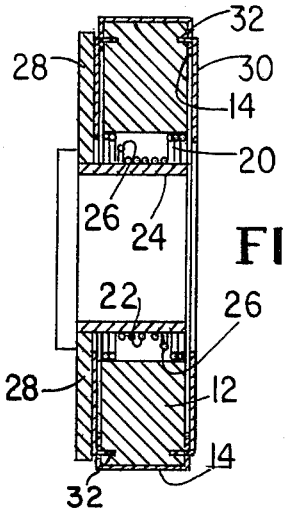
FIG. 3 is a sectional view taken along lines 3—3 of FIG. 1.

The inking wheel according to the invention shall be designated generally by reference character 10 in FIG. 1 and comprises an annular ring 12 of cellular material having a generally rectangular cross-section, the consistency of the ring being firm. The ring 12 can be formed of relatively firm microporous cellular material which may or may not be preinked, and/or if desired, may include a textile cover or sock 14.

The ring 12 is mounted on a support defined by a coil spring 16 axially seated concentrically within the central axial passage 18 of the ring 12. The spring 16 has a pair of axially aligned outer coils 20 which provide the direct support for the ring 12. The outer diameter of coils 20 is the same or slightly larger than the inner diameter of the passage 18. The spring 16 also has an inner coil 22 which seats the spring 16 onto the hub 24 of the inking wheel 10. The inner diameter of coil 22 is the same as or slightly smaller than the outer diameter of the hub 24; that is, no greater than said outer diameter of the hub 24. Disc 28 seats hub 24.

Linking or bridging coils 26 join the outer coils 20 to the opposite ends of inner coil 22, coils 26 being integral with coils 20 and 22. The number of turns comprising the bridging coils 26 are dependent upon the size of the wire used to form the spring 16, as well as the factors of speed of operation, the material of which the ring is formed, which of course is a considerable factor used to determine the size of the wire employed. This is likewise true insofar as the number of turns defining coils 20, 22. The degree of resilience afforded by the concentrically arranged spring 16, to a considerable degree, depends upon the number of turns comprising same. One preferred example has been constructed of 0.080 wire and therein, the coils 26 were each formed of one and one-half turns. The outer coils 20 comprised two and one-half turns each while the inner coil 22 was formed of four and a fraction turns. At least one turn is required for coil 26.

In assembling the wheel 10, the spring 16 is inserted axially in the passage 18 of the ring 12 and slipped fractionally thereinto so that the coils 20 are seated at the opposite ends of said passage. If necessary, the spring 16 is given a slight twisting rotation as it is seated, such manipulation narrowing the outer diameter of coils 20 fractionally or to enable the bridging coils 26 to be compressed slightly in an axial direction. A frictional engagement of spring 16 fully within passage 18 thus is achieved. The assembled ring 12 and spring 16 is seated onto the circumferential surface of hub 24 and establishes a frictional engagement therewith, which, because a fractional expansion of the coil 22, is possible during such assembly. The bias effected by the coil's (22) return to its original or before assembly inner diameter, forces the spring 16 tightly to grasp the hub 24 to provide resistance to relative rotation therewith when the assembled inking wheel 10 is employed.

The inking ring 12 may be formed of a relatively firm, fibrous material such as a composite cellulose fiber and phenolic bound cellulose fiber such as commercially used for water filter material. As shown in the FIGURES, an outer sleeve or sock 14 formed of woven textile material may be employed as an outer skin for the ring 12. In such instances, annular metal disc plates 30 having barbs 32 are employed to secure the sock or cover 14 onto the ring 12. The plates 30 each are provided with central openings 34 having an inner diameter slightly less than the diameter of passage 18 of the ring 12 so as to assure retention of the spring 16 within said passage 18 which may be encountered as a result of slippage of the spring 16 during operation of the inking wheel 10. One also can describe the openings 34 as having a diameter less than the outer diameter of the outer coils 20. The inking ring 12 may be reinked after depletion of ink therefrom or may be removed and discarded. The spring 16 is not affected by ink or solvents and may be reused over and over again.

The inking wheel 10, according to the invention, is capable of use in conjunction with operations where either constant or intermittent contact with a transfer roller wheel (not shown) or an imprinting wheel 36 occurs. Adjustment means (not shown) are employed preferably to urge the outer circumferential surface of the ring 12 against the wheel 36 for reception of ink thereupon. The outer coils 20 have limited radial freedom of movement relative to the inner coils 22 and the hub 24 due to the resilience or give provided by the bridging coils 26.

Axial movement is restricted. However, concentricity of the ring 12 about the hub 24 is maintained due to the concentricity of the spring coils 20 and 22 and the resilience provided by coils 26. The ring "gives" a little but always returns to its proper concentric relationship with the hub 24. The permitted radial "give" serves materially to reduce the collapse of the internal structure of the ring 12 as the ink content is reduced. This in turn reduces shrinkage which would otherwise result in significant reduction in ring diameter. This in turn assures positioning effective to assure continued firm engagement with the surface to which ink is transferred without flattening, scarring or otherwise deleteriously affecting either the type surface (if the surface to which ink is applied is the imprinting type carried by an imprinting wheel 36) or if the surface to which ink is applied comprises a transfer roller. Contact is sufficient and is maintained uniformly for a duration to effect a controlled ink flow from the inking ring, particularly reducing the number of voids encountered in use of the coventional inking wheels.

As mentioned above, when the ring 12 is released from contact with the surface to which ink has been applied, the support spring 16 returns to its concentric condition carrying therewith the ring 12. The wheel is not off-center as encountered say with aging, etc. of the earlier described sponge-like insert comprising the resilient support of the said earlier application yet without loss of any of the advantages thereof. The sleeves previously utilized are not required resulting in considerable cost savings both in parts, materials and assembly.

The preferred embodiment employs the outer, wider diameter coils to engage the ring 12 while the inner coil is used as a mounting to seat the ring and support upon the hub 24. The invention herein contemplates forming the innermost coil as the wider diameter coil to engage the ring while the outer coils are of narrower diameter to engage the hub.

Variations can be made to the embodiment of the invention illustrated and described herein without departing from the spirit and scope of the invention as claimed hereinafter.

What I claim is:

1. An inking wheel for transferring ink to a secondary surface in a rolling contact engagement therewith comprising, a hub, a ring of ink absorbent material, said ring having a central axial passage, a resiliently yieldable support for said ring engageable with said hub, said resilient support being seated within said axial passage and comprising; a concentrically disposed coil spring having a pair of outer coils, and inner coil and a pair of bridging coils at opposite ends of the inner coil linking said outer and inner coils, one of said outer coil pair and inner coil mounting said ring and the other of said outer coil pair and inner coil capable of being engaged on said hub.

2. The inking wheel as claimed in claim 1 in which said outer coil pair mounts said ring and said inner coil is capable of engagement with said hub.

3. The inking wheel as claimed in claim 2 in which said outer coils have an outer diameter no less than the inner diameter of said axial passage.

4. The inking wheel as claimed in claim 2 in which said inner coil has an inner diameter no greater than the diameter of the hub.

5. The inking wheel as claimed in claims 1, 2 or 3 in which said inking ring is formed of a relatively firm inking material.

6. The inking wheel as claimed in any one of claims 1, 2 or 3 in which said inking ring is formed of a relatively firm inking material and disc means secured to opposite axial side ends of the ring.

7. The inking wheel as claimed in any one of claims 1, 2, or 3 in which said inking ring is formed of a relatively firm inking material, said ring having an outer skin formed of a woven material.

8. The inking wheel as claimed in any one of claims 1, 2 or 3 in which said inking ring is formed of a relatively firm inking material, said ring having an outer skin formed of a woven textile and disc means secured to the opposite axial ends of said ring fixing the skin in place.

9. The inking wheel as claimed in claim 1 in which said inking ring is formed of a relatively firm inking material and disc means secured to opposite coaxial ends of said ring, said disc means comprising thin annular discs, each of said discs having a plurality of bent barb portions pressed into said ring ends.

10. The inking wheel as claimed in claim 2 in which said inking ring is formed of a relatively firm inking material and disc means secured to opposite coaxial ends of said ring, said disc means comprising thin annular discs, each of said discs having a plurality of bent barb portions pressed into said ring ends, said discs each having central axial openings, the diameter of which is slightly less than the diameter of said axial passage.

11. The inking wheel as claimed in claim 1 in which said inking ring is formed of a relatively firm inking material and disc means secured to opposite coaxial ends of said ring, said disc means comprising thin annular discs, each of said discs having a plurality of bent barb portions pressed into said ring ends, said discs each having central axial openings, the diameter of which is less than the outer diameter of said outer coils.

12. The inking wheel as claimed in claim 1 in which said bridging coils comprise at least one turn.

13. The inking wheel as claimed in claims 2 or 11 in which said inner coil has an inner diameter no greater than the outer diameter of the hub and said outer coils each have outer diameters no less than the diameter of the axial passage in which it is mounted.

* * * * *